US008955278B1

(12) United States Patent
Mills

(10) Patent No.: US 8,955,278 B1
(45) Date of Patent: Feb. 17, 2015

(54) SUBFLOOR DRAINAGE PANEL

(71) Applicant: Hilton R. Mills, Calgary (CA)

(72) Inventor: Hilton R. Mills, Calgary (CA)

( * ) Notice: Subject to any disclaimer, the term of this patent is extended or adjusted under 35 U.S.C. 154(b) by 0 days.

(21) Appl. No.: 14/280,069

(22) Filed: May 16, 2014

(51) Int. Cl.
*E04B 1/70* (2006.01)
*E04F 17/00* (2006.01)
*E04B 5/48* (2006.01)

(52) U.S. Cl.
CPC ..... *E04B 5/48* (2013.01)
USPC ..... 52/302.3

(58) Field of Classification Search
USPC ..... 52/302.3, 302.1, 302.4, 302.6, 302.7
See application file for complete search history.

(56) References Cited

U.S. PATENT DOCUMENTS

| | | | | |
|---|---|---|---|---|
| 2,956,785 | A * | 10/1960 | Richl | 165/56 |
| 3,303,771 | A * | 2/1967 | Nesher et al. | 454/187 |
| 3,388,516 | A | 6/1968 | Thielen | |
| 3,757,481 | A * | 9/1973 | Skinner | 52/265 |
| 4,943,185 | A | 7/1990 | McGuckin et al. | |
| 5,111,627 | A * | 5/1992 | Brown | 52/126.5 |
| 5,277,010 | A * | 1/1994 | Stephenson et al. | 52/403.1 |
| 5,399,406 | A | 3/1995 | Matsuo et al. | |
| 5,489,462 | A | 2/1996 | Sieber | |
| 5,619,832 | A | 4/1997 | Myrvold | |
| 5,930,970 | A | 8/1999 | De Le Fevrew | |
| 6,672,016 | B2 | 1/2004 | Janesky | |
| 6,918,215 | B2 | 7/2005 | Smith | |
| 7,033,666 | B2 | 4/2006 | Skaja | |
| 7,386,957 | B2 | 6/2008 | Duffney | |
| 7,404,689 | B1 | 7/2008 | Poling | |
| 7,861,488 | B2 | 1/2011 | Giles et al. | |
| 8,225,566 | B2 * | 7/2012 | Prevost et al. | 52/302.1 |
| 8,347,575 | B2 | 1/2013 | Bierwirth | |
| 8,356,450 | B2 | 1/2013 | Larimore | |
| 8,511,022 | B2 * | 8/2013 | Curtin et al. | 52/302.1 |
| 2002/0139068 | A1 * | 10/2002 | Janesky | 52/169.5 |
| 2003/0154676 | A1 | 8/2003 | Schwartz | |
| 2005/0224690 | A1 * | 10/2005 | Hobbs | 249/2 |
| 2008/0276557 | A1 * | 11/2008 | Rapaz | 52/302.3 |
| 2011/0283641 | A1 | 11/2011 | Aubut | |
| 2013/0111836 | A1 * | 5/2013 | Masanek et al. | 52/302.1 |
| 2013/0227904 | A1 | 9/2013 | Amend | |

FOREIGN PATENT DOCUMENTS

| | | | |
|---|---|---|---|
| CA | 2671446 | A1 | 1/2011 |

* cited by examiner

*Primary Examiner* — Mark Wendell
*Assistant Examiner* — Keith Minter
(74) *Attorney, Agent, or Firm* — David A. Guerra

(57) ABSTRACT

A subfloor drainage panel is provided for draining moisture from a floor. The subfloor drainage panel has an upper member, a lower member attached to the upper member, and an intermediate member located in the lower member. The lower member includes a plurality of first projections extending away from the upper member, a plurality of second projections extending toward the upper member, and at least one drain hole defined in the first projections. The first projections support the subfloor drainage panel on a surface. The intermediate member has a plurality of openings each configured to receive therethrough a portion of one of the second projections so as to contact and support the lower member. The lower member is configured to define a gap between a portion of the lower member and the surface, with the gap being configured to allow fluid to pass therethrough.

20 Claims, 5 Drawing Sheets

SUBFLOOR DRAINAGE PANEL

BACKGROUND OF THE INVENTION

1. Field of the Invention

The present invention relates to a subfloor drainage panel for use in connection with draining moisture and circulating air from a floor using a multi-component subfloor.

2. Description of the Prior Art

The use of subflooring systems is known in the prior art. A subfloor component is a panel or other component meant to be placed on top of a concrete floor or other foundation before a finished floor is installed thereon. The subfloor component may have projections for permitting the flow of moisture underneath the component so as to prevent moisture from standing thereunder and causing problems with mold or rot. While subfloor components of varying types are known, these known systems have disadvantages and improvements are desirable.

A finished floor usually consists of a subfloor and a flooring surface, supported by the subfloor. The nature of a subfloor will vary depending on the flooring surface it needs to support and the environment in which it must function. The flooring surface can be, but not limited to, carpeting, laminate flooring, tiles, linoleum, etc.

Basement flooring presents additional challenges, one of which is the possibility of moisture being present and another which is to insulate the floor from what a cold underlying surface of poured concrete, especially in colder climates. In basements, a fixed subfloors or "non-floating" subfloors can be used. This type of flooring may have an underlying sheet of semi rigid plastic having depending protrusions over which is placed a series of plywood panels. The panels are securely fixed to the underlying floor using concrete bolts or other fastening means.

While the above-described devices fulfill their respective, particular objectives and requirements, the aforementioned patents do not describe a subfloor drainage panel that allows draining moisture from a floor using a multi-component subfloor. Accordingly, it is an object of the present invention to provide a sub-floor panel capable of supporting a floor that will allow moisture drainage and air circulation between the flooring surface and the surface.

Therefore, a need exists for a new and improved subfloor drainage panel that can be used for draining liquid from a floor using a multi-component subfloor. In this regard, the present invention substantially fulfills this need. In this respect, the subfloor drainage panel according to the present invention substantially departs from the conventional concepts and designs of the prior art, and in doing so provide an apparatus primarily developed for the purpose of draining moisture from a floor using a multi-component subfloor.

SUMMARY OF THE INVENTION

In view of the foregoing disadvantages inherent in the known types of subflooring systems now present in the prior art, the present invention provides an improved subfloor drainage panel, and overcomes the above-mentioned disadvantages and drawbacks of the prior art. As such, the general purpose of the present invention, which will be described subsequently in greater detail, is to provide a new and improved subfloor drainage panel and method which has all the advantages of the prior art mentioned heretofore and many novel features that result in a subfloor drainage panel which is not anticipated, rendered obvious, suggested, or even implied by the prior art, either alone or in any combination thereof.

To attain this, the present invention essentially comprises a subfloor drainage panel for draining moisture from a floor. The subfloor drainage panel has an upper member, a lower member attached to the upper member, and an intermediate member located in the lower member. The lower member includes a plurality of first projections extending away from the upper member, a plurality of second projections extending toward the upper member, and at least one drain hole defined in the first projections. The first projections support the subfloor drainage panel on a surface. The intermediate member has a plurality of openings each configured to receive therethrough a portion of one of the second projections so as to contact and support the lower member. The lower member is configured to define a gap between a portion of the lower member and the surface, with the gap being configured to allow fluid to pass therethrough.

The upper member has at least one interlocking edge configured to join with an interlocking edge of an adjacent upper member of an adjacent subfloor drainage panel.

There has thus been outlined, rather broadly, the more important features of the invention in order that the detailed description thereof that follows may be better understood and in order that the present contribution to the art may be better appreciated.

The sidewalls of the first projections may also include at least one planar sidewall and at least one multi-angled sidewall adjacent the planar sidewall, wherein the multi-angled sidewall includes a first section angularly extending from a second section.

There are, of course, additional features of the invention that will be described hereinafter and which will form the subject matter of the claims attached. Such as the use of a ventilation manifold positioned adjacent to the subfloor drainage panel or along a periphery of multiple subfloor drainage panels. The ventilation manifold includes ports to circulate air to or from a wall, and bores to circulate the air to or from an area between the upper member and the surface.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved subfloor drainage panel that has all of the advantages of the prior art subfloor systems and none of the disadvantages.

It is another object of the present invention to provide a new and improved subfloor drainage panel that may be easily and efficiently manufactured and marketed.

An even further object of the present invention is to provide a new and improved subfloor drainage panel that has a low cost of manufacture with regard to both materials and labor, and which accordingly is then susceptible of low prices of sale to the consuming public, thereby making such subfloor drainage panel economically available to the buying public.

Still another object of the present invention is to provide a new subfloor drainage panel that provides in the apparatuses and methods of the prior art some of the advantages thereof, while simultaneously overcoming some of the disadvantages normally associated therewith.

Even still another object of the present invention is to provide a subfloor drainage panel for draining moisture from a floor using a multi-component subfloor. This allows for the drainage of moisture away from a flooring or surface to prevent moisture damage to the walls, flooring or items in the room. Furthermore, the subfloor drainage panel is configured to allow air circulation therethrough to assist in the evaporation of moisture and/or for controlling the temperature of the room.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
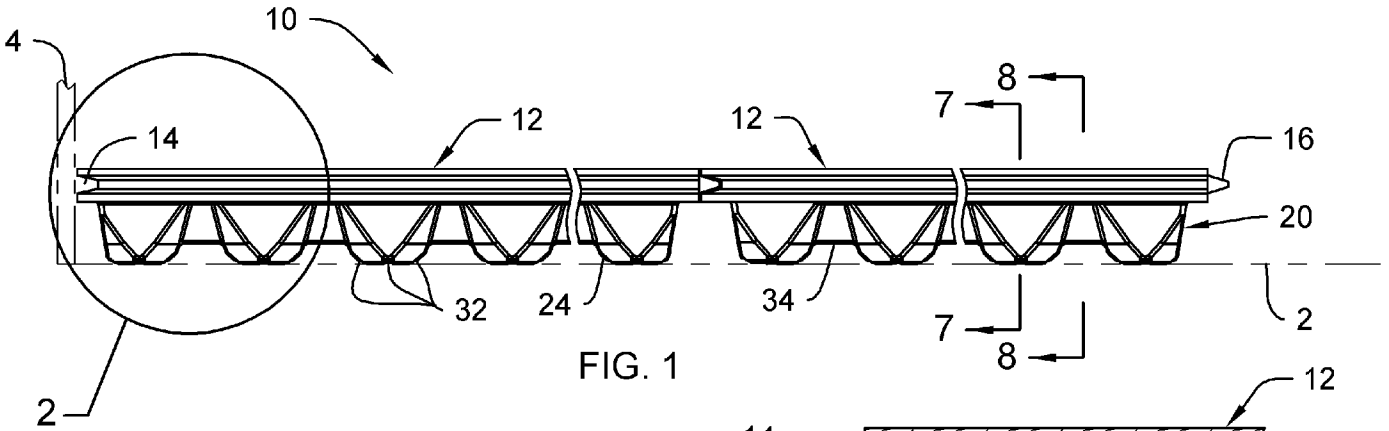
FIG. 1 is a side planar view of an embodiment of the subfloor drainage panel positioned on a surface or foundation and constructed in accordance with the principles of the present invention, with the phantom lines depicting environmental structure and forming no part of the claimed invention.

Referring now to the drawings, and particularly to FIGS. 1-11, an embodiment of the subfloor drainage panel of the present invention is shown and generally designated by the reference numeral 10.

Figure 2:
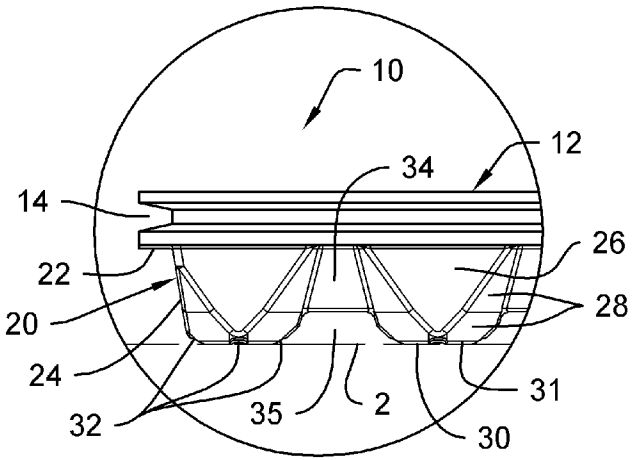
FIG. 2 is an enlarged side planar view of a portion of the subfloor drainage panel of FIG. 1 resting on the surface.

In FIGS. 1 and 2, a new and improved subfloor drainage panel 10 of the present invention for draining moisture from a floor using a multi-component subfloor is illustrated and will be described. More particularly, the subfloor drainage panel 10 has an upper member 12 and a lower member 20. The lower member 20 is attached to the upper member 12. The subfloor drainage panel 10 rests on a surface 2, and its edges can abut against a wall or stud 4, or additional subfloor drainage panels 10. The surface 2 may be, but not limited to, a pre-existing floor, foundation or substructure. The subfloor drainage panel 10 may be used on any floor a building or vehicle, in a basement, in the bilge of a marine vessel, in an aircraft, or in any area where potential flooding or moisture damage can occur. The subfloor drainage panel 10 may be square or any geometric shape, and manufactured in many dimensions.

The upper member 12 may be made of, but not limited to, wood, plywood, composite, plastic, metal, alloy, laminated layers, marble, concrete, construction board, particle board, wafer board or other construction sheeting. At least one edge of the upper member 12 defines a groove 14, and at least one edge includes a tongue or projection 16. The tongue 16 may feature straight or tapered edges, and the groove 14 has a shape corresponding to that of the tongue 16 so as to receive the tongue 16 therein. The tongue 16 and groove 14 may additionally include interlocking mechanisms that lock joined subfloor drainage panels 10 together.

It can be appreciated that multiple subfloor drainage panels 10 can be fitted together adjacent and interlocking one another via the tongue 16 and groove 14 joint, as best illustrated in FIG. 1. However, additional joinery or connection means can be utilized in place of the above described tongue and groove connection. It can also be appreciated that a top or exterior surface of the upper member 12 may include a finished floor or appearance, such as carpet, tiles, coatings, stains or decorative sheeting. The upper member 12 may be perforated therethrough to further allow the drainage of moisture or the circulation of air.

The lower member 20 may be made of, but not limited to, polyethylene, fiberglass, composite, plastic, metal, alloy or other suitable waterproof sheet material. The lower member 20 includes a flanged edge 22 along its periphery that may be attached to the upper member 12 using adhesives, fasteners or any other mechanical securing means. The lower member 20 also includes a plurality of projections 24 which rests on the surface 2 to support the subfloor drainage panel 10 on the surface 2. Moisture is allowed to drain through a plurality of drainage holes 32 defined through corners of each projection 24 of the lower member 20 when the subfloor drainage panel 10 is installed on the surface 2.

Figure 5:
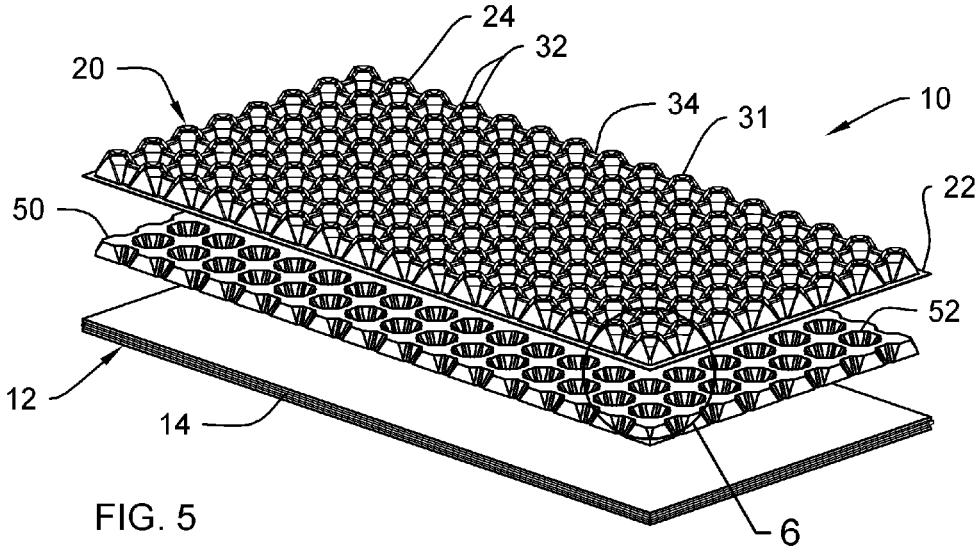
FIG. 5 is an inverted exploded perspective view of the subfloor drainage panel of the present invention.
Figure 6:
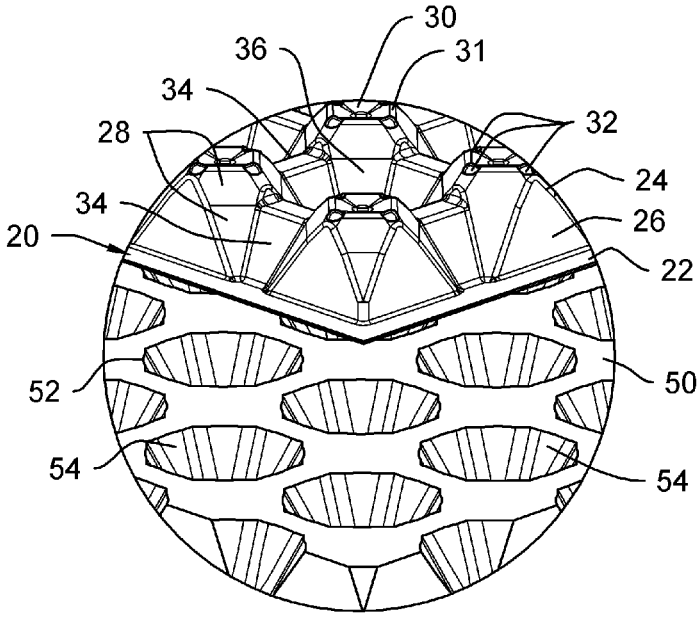
FIG. 6 is an enlarged view of a portion of the subfloor drainage panel of FIG. 5.

As best illustrated in FIGS. 2, 5 and 6, the projections 24 each are frustoconical in shape including multiple planar sides 26, multiple multi-angled sides 28 adjacent to a pair of the planar sides 26, and a base 30. The planar sides 26 have a triangular shape extending away from the upper member 12 in a converging manner. The multiple multi-angled sides 28 have an inverted triangular shape in relation to the triangular shape of the planar sides 26. A cavity is defined in the projections 24 extending from the base 30 toward the upper member 12 when assembled. The multi-angled sides 28 each include a first planar section, and a second planar section extending therefrom at an angle. The base 30 is recessed or concaved so as to provide a peripheral edge 31 that is in contact with the surface 2 when installed.

Defined in the peripheral edge 31 of the base 30 at each corner where corners of adjacent first sections of the multi-angled sides 28 meet is at least one of the drainage holes 32. In this manner, each projection 24 would include at least four drainage holes 32, but it can be appreciated that any number of drainage holes 32 can be used for each of the projections 24. The drainage holes 32 are defined at an angle in relation the surface 2 so as to elevate the drainage holes 32 from the surface 2, thereby allowing moisture to freely flow out from the drainage holes 32, as best illustrated in FIGS. 1 and 2.

The angle of the second planar section of the multi-angled sides 28 allows for the complex shape of the drainage holes 32 as being defined at adjacent corners of the second planar sections, in combination with the peripheral edge 31 of the base 30.

The projections 24 are arranged in a spaced apart relationship with each other in an array containing rows and columns. A ledge 34 is located between each adjacent projection 24 in the array. The ledge 34 has a height less than the height of each projection 24, thereby creating gaps 35 between the ledge 34 and the surface 2. The gaps 35 allow for fluid to flow and for the circulation of air beneath the subfloor drainage panel 10. The fluid may be, but not limited to, a subset of the phases of matter and include liquids, gases, plasmas and, to some extent, plastic solids.

Figure 3:
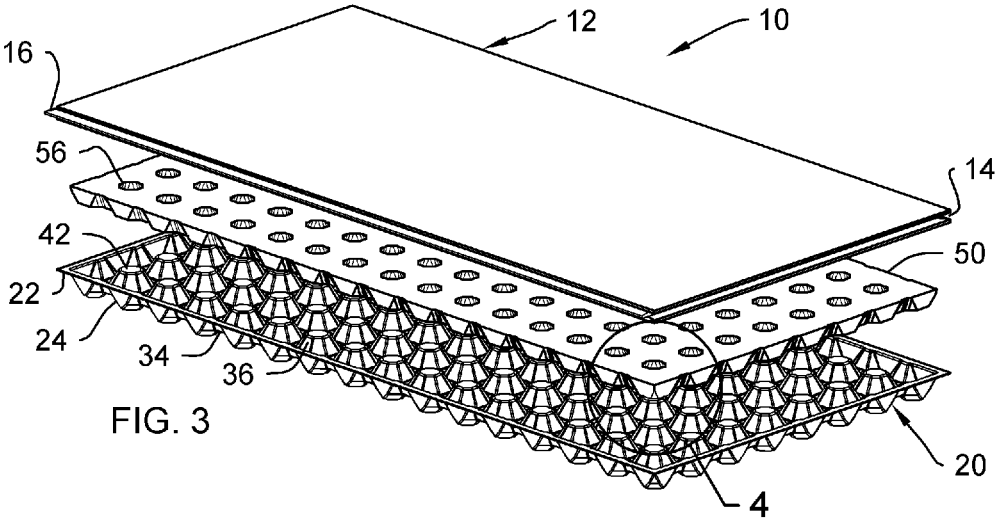
FIG. 3 is an exploded perspective view of the subfloor drainage panel of the present invention.
Figure 4:
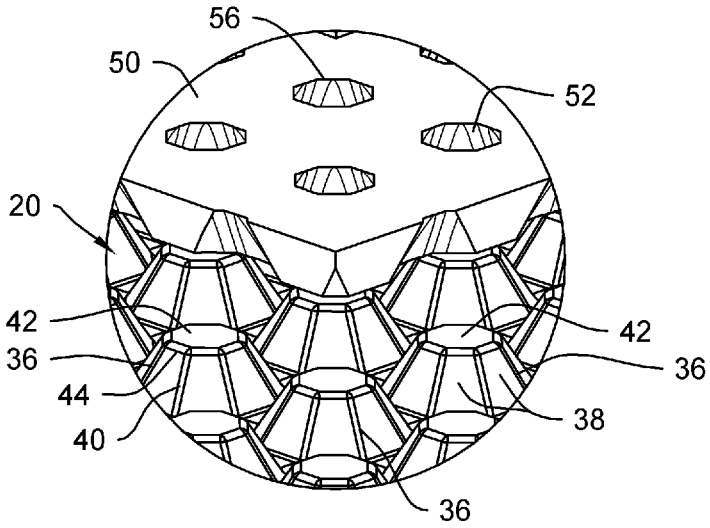
FIG. 4 is an enlarged view of a portion of the subfloor drainage panel of FIG. 3.

As best illustrated in FIGS. 3 and 4, the lower member 20 further includes internal projections 36 that extend toward the upper member 12, in a direction opposite the projections 24. The internal projections 36 are created between at least four adjacent projections 24 and their corresponding ledges 34. The internal projections 36 each include multiple planar sides 38, and a planar top side 42. It can be appreciated that the adjacent planar sides 38 may be a chamfered or filleted side edges 40, and a connection edge between the top side 42 and adjacent planar sides 38 may be a chamfered or filleted top edge 44.

The multiple planar sides 38 are tapered in a converging manner toward the top side 42. The number of planar sides 38 can be any number that creates geometric configurations dependent upon the number of projections 24 and ledges 34 that boundary the internal projection 36.

The top side 42 is on the same plane and has the same height as the flanged edge 22, thereby allowing the top side 42 to be in contact with and providing support to the upper member 12 when assembled. The top side 42 may be attached to the upper member 12 using adhesives, fasteners or any other mechanical securing means.

The subfloor drainage panel 10 also includes an intermediate member 50 received in an internal area and occupies an internal volume of the lower member 20. The intermediate member 50 may be made of, but not limited to, insulation material, foam, sand, concrete, plastic or any other insulating and water impermeable material. The intermediate member 50 may be formed prior to assembly into the lower member 20, or the internal area of the lower member 20 can be filled with material to form the intermediate member 50 in situ. The intermediate member 50 is configured to provide thermal insulation, additional rigidity, and additional structural support and strength to the subfloor drainage panel 10. The intermediate member 50 is also configured to allow moisture to travel to the drainage holes 32 of the projections 24.

The intermediate member 50 includes a plurality of cavities 52, as best illustrated in FIG. 6, that have a shape that corresponds with the internal projections 36 of the lower member 20, so as to receive therein at least one of the internal projections 36. The cavities 52 each feature multiple tapering planar sides 54 that correspond with the planar sides 38 of the internal projection 36 received therein. As best illustrated in FIGS. 3 and 4, the intermediate member 50 additionally includes a plurality of openings 56 each of which being in communication with one of the cavities 52. The openings 56 are each configured to receive therethrough or therein the top side 42 of the internal projection 36. The openings 56 allow the top sides 42 of the internal projections 36 to contact the upper member 12, and allows for moisture to drain toward the drainage holes 32.

Figure 7:
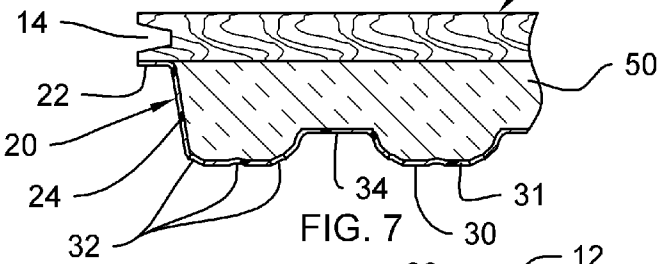
FIG. 7 is a cross-section view of the subfloor drainage panel taken along line 7 of FIG. 1.
Figure 8:
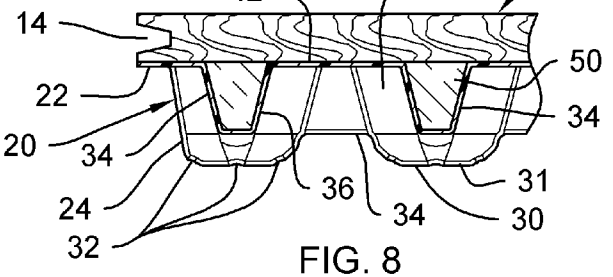
FIG. 8 is a cross-section view of the subfloor drainage panel taken along line 8 of FIG. 1.

As best illustrated in FIGS. 7 and 8, the flanged edge 22 in combination with the projections 24, the internal projections 36, the ledges 34 and the intermediate member 50 distribute any load supported by the upper member 12 to the surface 2. While the drainage holes 32 allow moisture drain from the subfloor drainage panel 10 and through the gaps 35, so that the moisture can be removed or evaporated, thus preventing or reducing moisture damage to the finished floor or adjacent walls.

It can be appreciated that the projections 24 featuring the planar sides 26, the multi-angled sides 28 and the recessed base 30, in combination with the internal projections 36 featuring the multiple tapered planar sides 38 and the planar top side 42, in further combination with the intermediate member 50 and the upper member 12, produces a rigid subflooring panel having increased strength to support a load thereupon.

It can further be appreciated that a moisture sensor (not shown) may be associated with the subfloor drainage panel 10, in the gaps 35 or on the surface 2 beneath the subfloor drainage panel 10. The moisture sensor may be in communication with an alarm system, a pump, a heating-ventilation-air conditioning (HVAC) system, and/or an air circulation system. The moisture sensor may further be in communication with a remote alerting system which transmits a signal to a user's cell phone, laptop or personal digital assistant (PDA) device, thereby alerting the user that potential water damage or issue is occurring.

Figure 9:
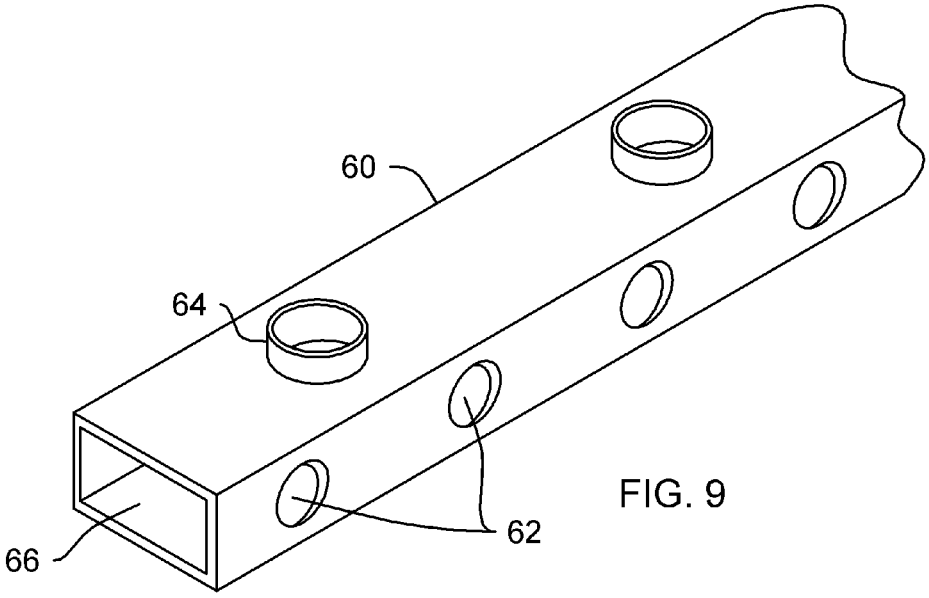
FIG. 9 is a perspective view of the ventilation manifold of the subfloor drainage panel of the present invention.
Figure 10:
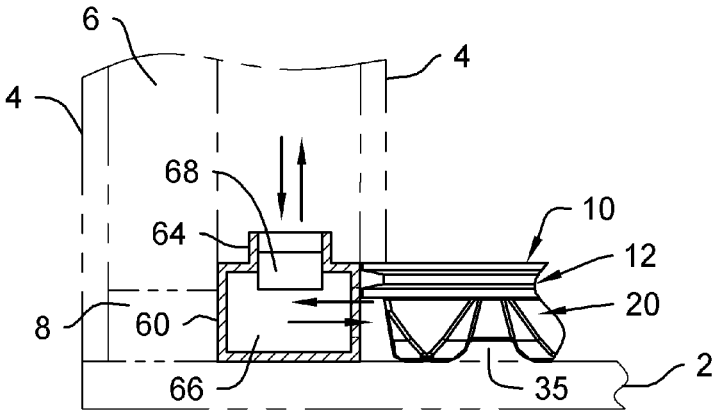
FIG. 10 is a cross-sectional view of the ventilation manifold in use with subfloor drainage panel of the present invention.
Figure 11:
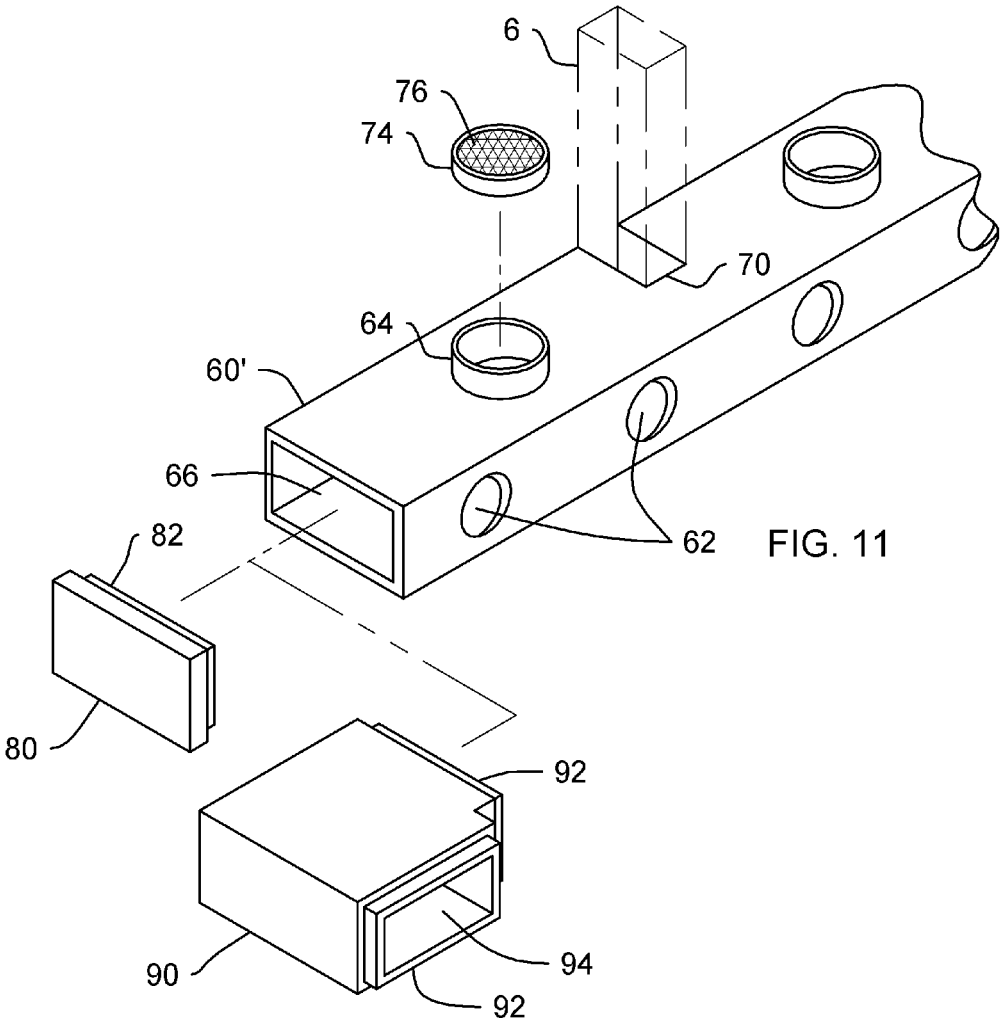
FIG. 11 is a perspective view of alternate embodiments of the ventilation manifold of the present invention.

Referring to FIGS. 9-11, the subfloor drainage panel 10 may be used with a ventilation manifold 60 for circulating ambient, cooled and/or heated air through the gaps 35 and opened areas defined beneath the upper member 12. The ventilation manifold 60 includes an elongated hollow housing featuring a plurality of a bores 62 defined through one side, at least one port 64 located on an upper side of the manifold, and a hollow interior 66 running the length of the manifold 60.

The manifold 60 may be located on the surface 2 adjacent a wall 4, a vertical stud 6 and/or a floor stud 8, as best illustrated in FIG. 10. The bores 62 are located so as to be in communication with the area of the subfloor drainage panel 10 beneath the upper member 12. A fan or blower 68 may be located within the port 64 and/or in the interior 66 of the manifold 60 so as to circulate air to and/or from the area beneath the upper member 12. The port 64 is configured to circulate air between the wall panels 4 or may include a deflector (not shown) that guides the circulated air between the wall panels 4. It can be appreciated that exhaust air can be vented outside the building the subfloor drainage panel 10 is installed in. This circulation of air can increase evaporation of any moisture on the surface 2, provide additional heating or cooling of the room where the subfloor drainage panel 10 is installed, and/or remove gases or odors from the room. It can be appreciated that the fan 68 may be controlled by the moisture sensor.

FIG. 11 illustrates an alternate embodiment ventilation manifold 60' which includes an elongated hollow housing featuring a plurality of the bores 62, the at least one port 64, the hollow interior 66, and at least one notch 70 configured to receive partially or entirely the vertical stud 6. The notch 70 allows the manifold 60' to be recessed in and between the wall panels 4 and studs 6.

Port caps 74 can be attached to the ports 64, and the port caps 74 may include screens or filters 76 to prevent debris, insects or animals from entering the manifold 60, 60' and/or filter the circulated air.

End caps 80 can be attached to the open ends of the manifold 60, 60'. The end caps 80 include a ledge or projection 82 that is received in the hollow interior 66. The end caps 80 will seal the ends of the manifold 60, 60' so that air can only be circulated through the bores 62.

Corner caps 90 can be attached to the open ends of the manifold 60, 60'. The corner caps 90 include a ledge or projection 92 that is received in the hollow interior 66, and a hollow interior 94. The corner caps 90 will seal the ends of the manifold 60, 60' and connect a second manifold 60, 60' at any angle thereto. The hollow interior 94 allows the circulated air to travel to and from the second manifold 60, 60'.

In use, it can now be understood that the subfloor drainage panel 10 of the present invention is placed on a surface of a room of a building to create an elevated subfloor that would allow moisture to drain in the event of a waterline or plumbing pipe rupture. Thereby, preventing or reducing moisture damage to the surrounding walls and/or flooring. Multiple subfloor drainage panels may be connected together to cover the surface, and easily cut so as to abut adjacent walls and/or structures. With the subfloor drainage panels installed, flooring can be placed on top of the upper member thereby finishing the floor.

Moisture will pass through and/or around the subfloor drainage panel and any moisture in the lower member will drain out through the drainage holes. The gaps created between the lower member and the surface provides a pathway for the moisture to travel and be removed. The gaps additionally provide a channel for air to circulate through, thereby assisting in the evaporation of moisture in the gaps, removal of odors, prevention of mold or mildew, and heating, cooling or insulations of the room.

A method of manufacturing a subfloor drainage panel 10 described above may be accomplished by preparing the upper member 12 as a final floor finish or to accept attachment of flooring. The tongue and grooves are cut or routed along the edges, as predetermined for assembly with adjacent subfloor drainage panels 10.

The lower member 20 is formed by a molding technique, such as but not limited to, injection molding or vacuum molding. A mold of the lower member is produced for this purpose, and it will be understood that the terms top and bottom may be interchanged with left and right, for example, in the case of a mold structure that stands vertically. The drainage holes 32 may be formed during the molding process or after by a cutting, grinding, routing or burning process.

The intermediate member 50 may be formed by a molding technique and then assembled into the lower member 20, or by injecting or filling the interior volume of the lower member with a curable material and then allowing the curable material to harden.

After the lower member 20 and the intermediate member 50 are assembled or formed, then at least the flanged edge 22 is secured or glued to the upper member 12. It can be appreciated that the top sides 42 of the internal projections 36 may also be secured or glued to the upper member 12.

While embodiments of the subfloor drainage panel have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the above described. And although draining moisture or liquid from a floor using a multi-component subfloor have been described, it should be appreciated that the subfloor drainage panel herein described is also suitable for elevating a floor while providing air circulation thereunder.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A subfloor drainage panel for draining moisture or circulating air to or from a surface, said subfloor drainage panel comprising:

an upper member;

a lower member attached to said upper member, said lower member having a plurality of first projections extending away from said upper member, a plurality of second projections extending toward said upper member, and at least one drain hole defined in said first projections, said first projections each having a base configured to support said subfloor drainage panel on the surface, said second projections each having a height to contact said lower member; and an intermediate member located in said lower member, said intermediate member defining a plurality of openings each configured to receive therethrough a portion of one of said second projections of said lower member;

wherein said lower member being configured to define a gap between said lower member and the surface, said gap being configured to allow fluid to pass therethrough.

2. The subfloor drainage panel according to claim 1, wherein said upper member further comprises at least one interlocking edge configured to join with an interlocking edge of an adjacent upper member of an adjacent subfloor drainage panel.

3. The subfloor drainage panel according to claim 2, wherein said interlocking edge is selected from the group consisting of a tongue, and a groove.

4. The subfloor drainage panel according to claim 1, wherein said lower member further comprises at least one ledge between adjacent said first projections, said ledge extending away from said upper member a distance less than said first projections to define said gap.

5. The subfloor drainage panel according to claim 4, wherein said first projections each includes sidewalls tapering toward said base of said first projections.

6. The subfloor drainage panel according to claim 5, wherein a portion of said drain hole is defined through a portion of at least one of said sidewalls.

7. The subfloor drainage panel according to claim 6, wherein a second portion of said drain hole is defined through a portion of said base.

8. The subfloor drainage panel according to claim 5, wherein said sidewalls include at least one planar sidewall, and at least one multi-angled sidewall adjacent said planar sidewall, said multi-angled sidewall includes a first section angularly extending from a second section.

9. The subfloor drainage panel according to claim 8, wherein said planar sidewall of each of said first projections is a plurality of triangularly shaped planar sidewalls, and said multi-angled sidewall of each of said first projections is a plurality of multi-angled sidewalls each having a triangular shape inverted to that of said planar sidewall, with a triangle base of each of said triangular shaped multi-angled sidewalls being adjacent a peripheral edge of said base of said first projections.

10. The subfloor drainage panel according to claim 9, wherein said second projections include sidewalls that taper toward said upper member.

11. The subfloor drainage panel according to claim 10, wherein said sidewalls of said second projections is at least one planar sidewall extending from said ledge, and said second section of said multi-angled sidewall of said first projections.

12. The subfloor drainage panel according to claim 5, wherein said base includes a recessed portion and a peripheral edge, said peripheral edge is adjacent a portion of said multi-angled sidewall.

13. The subfloor drainage panel according to claim 12, wherein a portion of said drain hole is defined in said peripheral edge of said base.

14. The subfloor drainage panel according to claim 13, wherein a second portion of said drain hole is defined through a portion of said multi-angled sidewall.

15. The subfloor drainage panel according to claim 4, wherein said first projections, said second projections, and said ledge are configured to distribute a load supported on said upper member to the surface.

16. The subfloor drainage panel according to claim 1, wherein said intermediate member defines a plurality of cavities each of which in communication with one of said openings, said plurality of cavities each having a configuration corresponding with a shape of said second projections, said plurality of cavities each being configured to receive one of said second projections.

17. A subfloor drainage panel comprising:

an upper member having at least one interlocking edge configured to join with an interlocking edge of an adjacent upper member of an adjacent subfloor drainage panel;

a lower member attached to said upper member and configured to rest on a surface, said lower member comprising:

a plurality of first projections extending away from said upper member in an array including rows and columns, said first projections each having a plurality of sidewalls tapering away from said lower member, a recessed base including a peripheral edge, and at least one drain hole defined in a portion of said peripheral edge of said recessed base and in a portion of at least one of said sidewalls; and a plurality of second projections extending toward said upper member in an array of rows and columns offset from said array of said first projections, said second projections each tapering toward said upper member, wherein at least one of said second projections having at least four sidewalls each of which being one of said sidewalls of one of said plurality of first projections, said second projections each having an upper surface configured to contact said lower member; and an intermediate member received in said lower member, said intermediate member defining a plurality of openings and a plurality of cavities each being in communication with one of said openings, each of said openings being configured to receive said upper surface of one of said second projections therethrough, each of said plurality of cavities being configured to receive one of said second projections therein;

wherein said lower member being configured to define a gap between a portion of said lower member and the surface, said gap being configured to allow fluid to pass therethrough;

wherein said peripheral edge of said recessed base of said first projections being configured to contact the surface, with said recessed base being recessed away from the surface.

18. The subfloor drainage panel according to claim 17, wherein said lower member further comprises at least one ledge between adjacent said first projections, said ledge extending away from said upper member a distance less than said first projections to define said gap.

19. The subfloor drainage panel according to claim 17, wherein said sidewalls of said first projections include at least one planar sidewall, and at least one multi-angled sidewall adjacent said planar sidewall, said multi-angled sidewall includes a first section angularly extending from a second section.

20. The subfloor drainage panel according to claim 19, wherein said planar sidewall of each of said first projections has a substantially triangular shape, and said multi-angled sidewall of each of said first projections has a substantially triangular shape that is inverted to that of said first projections, said triangular shaped multi-angled sidewall has a base edge being adjacent said peripheral edge of said recessed base of said first projections.

* * * * *